US011371697B2

(12) United States Patent
Acosta Herrero et al.

(10) Patent No.: US 11,371,697 B2
(45) Date of Patent: Jun. 28, 2022

(54) GAS BURNER, GAS BURNER ASSEMBLY AND DOMESTIC COOKING APPLIANCE

(71) Applicant: BSH Hausgeräte GmbH, Munich (DE)

(72) Inventors: Luis Acosta Herrero, Maliaño (ES); Melca Gutierrez Humara, La Penilla (ES); Alberto Lopez Ortiz, Santander (ES); Luis Antonio Palacios Valdueza, Astillero (ES); Emilio Placer Maruri, Liencres (ES)

(73) Assignee: BSH Hausgeräte GmbH, Munich (DE)

( * ) Notice: Subject to any disclaimer, the term of this patent is extended or adjusted under 35 U.S.C. 154(b) by 67 days.

(21) Appl. No.: 16/645,802

(22) PCT Filed: Aug. 30, 2018

(86) PCT No.: PCT/IB2018/056614

§ 371 (c)(1),
(2) Date: Mar. 10, 2020

(87) PCT Pub. No.: WO2019/053542

PCT Pub. Date: Mar. 21, 2019

(65) Prior Publication Data

US 2020/0271314 A1 Aug. 27, 2020

(30) Foreign Application Priority Data

Sep. 12, 2017 (ES) ..... P201731107

(51) Int. Cl.
*F23D 14/06* (2006.01)
*F23D 14/64* (2006.01)
*F24C 3/08* (2006.01)

(52) U.S. Cl.
CPC ..... *F23D 14/06* (2013.01); *F23D 14/64* (2013.01); *F24C 3/085* (2013.01)

(58) Field of Classification Search
CPC ..... F23D 14/06; F23D 14/62; F23D 14/64; F23D 14/02; F23D 14/26
(Continued)

(56) References Cited

U.S. PATENT DOCUMENTS 4,518,346 A 5/1985 Pistien
5,490,778 A * 2/1996 Meijer ..... F23D 14/06 239/554
(Continued)

FOREIGN PATENT DOCUMENTS

EP 0719982 A1 * 7/1996 ..... F23D 14/06
GB 1443521 A 7/1976

OTHER PUBLICATIONS

Translated Description of EP 0719982 A1 (Year: 1996).*
(Continued)

*Primary Examiner* — Jorge A Pereiro
*Assistant Examiner* — Nikhil P Mashruwala
(74) *Attorney, Agent, or Firm* — Michael E. Tschupp; Andre Pallapies; Brando G. Braun

(57) ABSTRACT

A gas burner for a household cooking appliance includes a burner casing including a plurality of mixture outlet openings configured to guide out, during operation of the gas burner, a mixture of combustion gas and primary air into an area surrounding the gas burner for producing a burner flame. A mixture distribution chamber evenly distributes the mixture of combustion gas and primary air to the mixture outlet openings. Fluidly connected with the mixture distribution chamber is a storage chamber for storing, during operation of the gas burner, part of the mixture of combustion gas and primary air. The storage chamber includes an ignition flame opening configured to guide out the mixture
(Continued)

of combustion gas and primary air that is stored in the storage chamber into the surrounding area for producing an ignition flame.

16 Claims, 8 Drawing Sheets

(58) Field of Classification Search
USPC ..... 431/354; 126/39 E
See application file for complete search history.

(56) References Cited

U.S. PATENT DOCUMENTS 5,924,860 A * 7/1999 Massey ..... F23D 14/06 431/266
6,067,978 A * 5/2000 Schlosser ..... A47J 37/0713 126/39 E
6,322,354 B1 * 11/2001 Carbone ..... F23D 14/02 126/39 E
6,332,460 B1 * 12/2001 Paesani ..... F23D 14/06 126/39 R
6,889,685 B2 * 5/2005 Dane ..... F23D 14/06 126/39 B
7,291,009 B2 * 11/2007 Kamal ..... F24C 3/085 431/278
9,074,765 B2 * 7/2015 Armanni ..... F23D 23/00
10,551,056 B2 * 2/2020 Caloca ..... F23D 14/06
10,677,469 B2 * 6/2020 Paller ..... F24C 3/082
2009/0087804 A1 4/2009 Pryor et al.
2011/0120445 A1 * 5/2011 Armanni ..... F23D 14/06 126/39 E
2013/0174837 A1 7/2013 Cadima
2014/0345598 A1 * 11/2014 Da Silva ..... F24C 3/10 126/39 E

OTHER PUBLICATIONS

International Search Report PCT/IB2018/056614 dated Nov. 16, 2018.
National Search Report ES P201731107 dated Nov. 19, 2018.

* cited by examiner

GAS BURNER, GAS BURNER ASSEMBLY AND DOMESTIC COOKING APPLIANCE

CROSS-REFERENCES TO RELATED APPLICATIONS

This application is the U.S. National Stage of International Application No. PCT/IB2018/056614, filed Aug. 30, 2018, which designated the United States and has been published as International Publication No. WO 2019/053542 A1 and which claims the priority of Spanish Patent Application, Serial No. P201731107, filed Sep. 12, 2017, pursuant to 35 U.S.C. 119(a)-(d).

BACKGROUND OF THE INVENTION

The present invention relates to a gas burner for a household cooking appliance, to a gas burner arrangement having a gas burner of this kind, and to a household cooking appliance having a gas burner of this kind and/or a gas burner arrangement of this kind.

Gas burners for household cooking appliances usually comprise a burner base, in which there may be provided a mixing chamber, a nozzle holder having a gas nozzle for injecting combustion gas into the mixing chamber, and a burner lid that is laid on the burner base and has mixture outlet openings. When the combustion gas is injected into the mixing chamber, primary air is drawn in by suction, laterally between the gas nozzle and an inflow edge of the mixing chamber, and mixed with the combustion gas. The resulting mixture of combustion gas and primary air is supplied to a mixture distribution chamber provided between the burner base and the burner lid, and from there is distributed evenly to the mixture outlet openings, for the purpose of forming a flame. In order to enable a burner flame of the gas burner to be reignited if it is extinguished, a gas burner of this kind may have a so-called pilot flame or ignition flame that is supplied with combustion gas by way of a separate gas supply line.

BRIEF DESCRIPTION OF THE DRAWINGS

Taking this as a starting point, an object of the present invention is to provide an improved gas burner.

Accordingly, a gas burner for a household cooking appliance is proposed. The gas burner comprises a burner casing that comprises a plurality of mixture outlet openings from which, during operation of the gas burner, a mixture of combustion gas and primary air may be guided out into an area surrounding the gas burner for the purpose of producing a burner flame, a mixture distribution chamber for evenly distributing the mixture of combustion gas and primary air to the mixture outlet openings, and a storage chamber that is in fluidic connection with the mixture distribution chamber in order, during operation of the gas burner, to store some of the mixture of combustion gas and primary air in the storage chamber, wherein the storage chamber comprises an ignition flame opening from which the mixture of combustion gas and primary air that is stored in the storage chamber may be guided out into the surrounding area for the purpose of producing an ignition flame.

Figure 1:
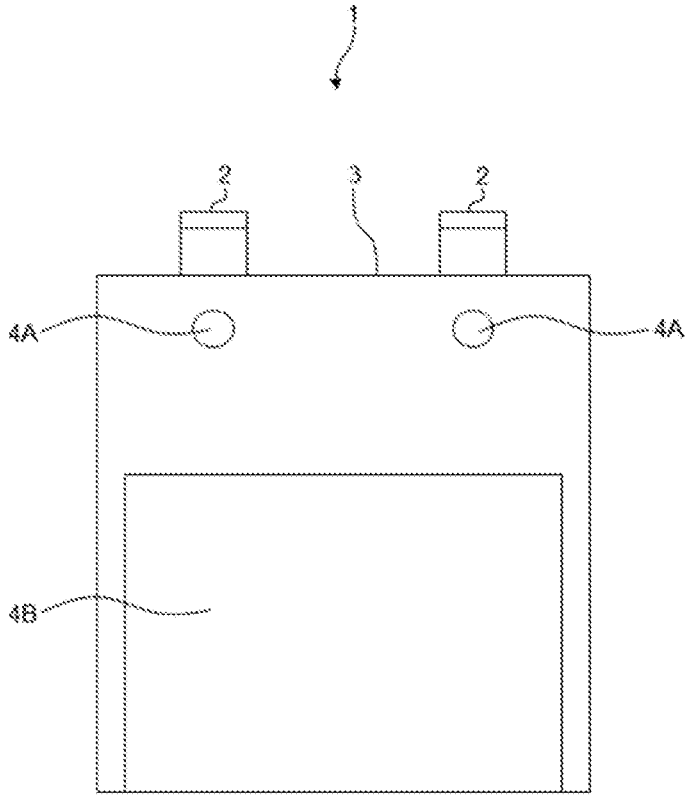

Because the storage chamber is provided for storing the mixture of combustion gas and primary air, the ignition flame can continue to burn even in the event of a brief interruption in the supply of combustion gas and/or in the event of the burner flame being extinguished, for example because a door of the household cooking appliance is opened or closed, without an additional gas supply line to the ignition flame opening in order to reignite the burner flame.

The expression that the storage chamber is in fluidic connection with the mixture distribution chamber should be understood to mean that the mixture of combustion gas and primary air can flow from the mixture distribution chamber into the storage chamber. The storage chamber is in particular separate from the mixture distribution chamber. That is to say that a wall in the burner casing may be provided between the mixture distribution chamber and the storage chamber. The ignition flame may also be designated a pilot flame. The storage chamber may be intended to store the mixture of combustion gas and primary air for periods from fractions of a second to several seconds, in order to supply the ignition flame with the mixture of combustion gas and primary air over this period even in the event of an interruption in the supply of combustion gas. The ignition flame opening may be a bore or an aperture.

According to one embodiment, the storage chamber runs peripherally around the mixture distribution chamber in a ring shape.

That is to say that the mixture distribution chamber is arranged within the storage chamber. In particular, the storage chamber may be provided in a wall that runs peripherally around the mixture distribution chamber.

According to a further embodiment, the ring-shaped geometry of the storage chamber is open.

This should be understood to mean that the storage chamber does not form a closed ring but an open ring. For example, the storage chamber may cover a peripheral angle of less than 360°, for example from 300° to 350°.

According to a further embodiment, the storage chamber has a rectangular cross section.

As an alternative, the storage chamber may also have a semicircular or a circular cross section. The storage chamber may in principle have any desired cross sectional geometry. Preferably, however, the storage chamber has a rectangular cross section and is provided as a rectangular groove in the above-mentioned wall of the mixture distribution chamber.

According to a further embodiment, the mixture distribution chamber and the storage chamber are constructed to be rotationally symmetrical about an axis of symmetry of the burner casing.

In particular, the burner casing is also constructed to be substantially rotationally symmetrical about the axis of symmetry. In particular, the mixture distribution chamber runs peripherally around the axis of symmetry in a ring shape, and the storage chamber in turn runs peripherally around the mixture distribution chamber in a ring shape.

According to a further embodiment, the storage chamber is in fluidic connection with the mixture distribution chamber with the aid of a supply opening.

As an alternative, it is also possible for a plurality of supply openings, for example two or three supply openings, to be provided. In particular, the supply opening takes the form of a bore. The supply opening may have a circular cross section. As an alternative, the supply opening may also have any other desired geometry. The supply opening may have a different diameter from the ignition flame opening. For example, a diameter of the supply opening may be larger than a diameter of the ignition flame opening, or vice versa.

According to a further embodiment, the storage chamber forms a cavity that, apart from the ignition flame opening and the supply opening, is entirely surrounded by the burner casing.

That is to say that, in the burner casing, the storage chamber preferably forms a completely enclosed hollow that is only in fluidic connection with the surrounding area by way of the ignition flame opening and with the mixture distribution chamber by way of the supply opening.

According to a further embodiment, the ignition flame opening is provided at a first end portion of the storage chamber, and the supply opening is provided at a second end portion of the storage chamber, at the opposite end to the first end portion.

As mentioned above, the storage chamber preferably has an open ring-shaped geometry. The first end portion and the second end portion are in this case at opposite ends to one another, and are arranged at the maximum possible distance from one another. As a result, the mixture of combustion gas and primary air has to cover the longest possible path from the supply opening to the ignition flame opening.

According to a further embodiment, the burner casing comprises a nozzle holder, a burner top and a burner lid, wherein the burner base is arranged between the nozzle holder and the burner lid.

In particular, the burner base is permanently connected to the nozzle holder. The burner lid is laid on the burner base such that it is not fixed. For example, the burner base is screwed to the nozzle holder. Between the burner base and the nozzle holder there may be provided a hob plate with an aperture. In that case, the gas burner is guided through the aperture. The hob plate is preferably clamped between the nozzle holder and the burner base.

According to a further embodiment, the mixture distribution chamber and the storage chamber are provided in the burner base.

The burner base, the nozzle holder and the burner lid are preferably mutually separate parts. The burner base, the burner lid and the nozzle holder may be made for example as die-cast aluminum parts or as die-cast magnesium parts.

According to a further embodiment, the burner casing has a closure plate that closes the storage chamber off in the direction of the nozzle holder.

The closure plate is for example glued, welded, screwed, riveted or caulked to the burner base. The closure plate is for example a steel plate. The closure plate is associated with the burner base, and is part of the burner base. The storage chamber preferably takes the form of a groove that is made in the burner base and is closed off with the aid of the closure plate.

According to a further embodiment, the burner base comprises a mixing chamber that is in fluidic connection with the mixture distribution chamber, for the purpose of mixing combustion gas with primary air, wherein the mixing chamber extends at least in part through the mixture distribution chamber.

In particular, the mixing chamber opens into the mixture distribution chamber. The burner base preferably comprises a disk-shaped underlying portion on which the mixing chamber is provided centrally. The mixing chamber is preferably delimited by a peripheral wall.

According to a further embodiment, the nozzle holder comprises a gas nozzle for injecting combustion gas into the mixing chamber, wherein the gas nozzle is arranged at a distance from an inflow edge of the mixing chamber.

That is to say that the gas nozzle is arranged outside the mixing chamber. During operation of the gas burner, the gas nozzle injects the combustion gas into the mixing chamber, as a result of which primary air is drawn in by suction, laterally past the gas nozzle and into the mixing chamber, where it is mixed with the combustion gas to form the mixture of combustion gas and primary air.

Moreover, a gas burner arrangement having a hob plate and at least one gas burner of this kind mounted on the hob plate is proposed.

The gas burner arrangement may comprise any desired number of gas burners. The hob plate may be for example a steel plate, a glass ceramic plate or a plate of tempered glass.

Further, a household cooking appliance, in particular a gas cooker, having a gas burner of this kind and/or a gas burner arrangement of this kind is proposed.

Preferably, the household cooking appliance has a plurality of gas burners of this kind. A gas regulating valve or gas control valve may be associated with each gas burner. The gas control valve may be intended to regulate, continuously variably or in steps, a volumetric flow of combustion gas to the gas nozzle. It is also possible for the gas control valve to be a so-called step valve. The household cooking appliance may be a free-standing appliance or a built-in appliance. Preferably, the household cooking appliance is a household gas cooker. For example, the household cooking appliance may have four gas burners of this kind. The gas control valve is connected up to a main gas line of the household cooking appliance, and is fluidically connected to the gas burner associated therewith by way of a gas supply line. Moreover, there may also be associated with each gas burner an ignition device that may be integrated into the gas control valve, and an ignition element that is arranged directly on the gas burner—for example an igniter. Moreover, each gas burner may also have a thermocouple for monitoring the flame. The thermocouple is electrically connected to the gas control valve of the respective gas burner.

Further possible implementations of the gas burner, the gas burner arrangement and/or the household cooking appliance also include features or embodiments, described above or below in relation to the exemplary embodiments, in combinations that are not explicitly mentioned. In this context, those skilled in the art will also incorporate individual aspects as improvements or additions to the respective basic form of the gas burner, the gas burner arrangement and/or the household cooking appliance.

BRIEF DESCRIPTION OF THE DRAWINGS

Further advantageous configurations and aspects of the gas burner, the gas burner arrangement and/or the household cooking appliance form the subject-matter of the subclaims, and the exemplary embodiments described below, of the gas burner, the gas burner arrangement and/or the household cooking appliance. Below, the gas burner, the gas burner arrangement and/or the household cooking appliance will be explained in more detail on the basis of preferred embodiments, with reference to the attached figures.

Figure 2:
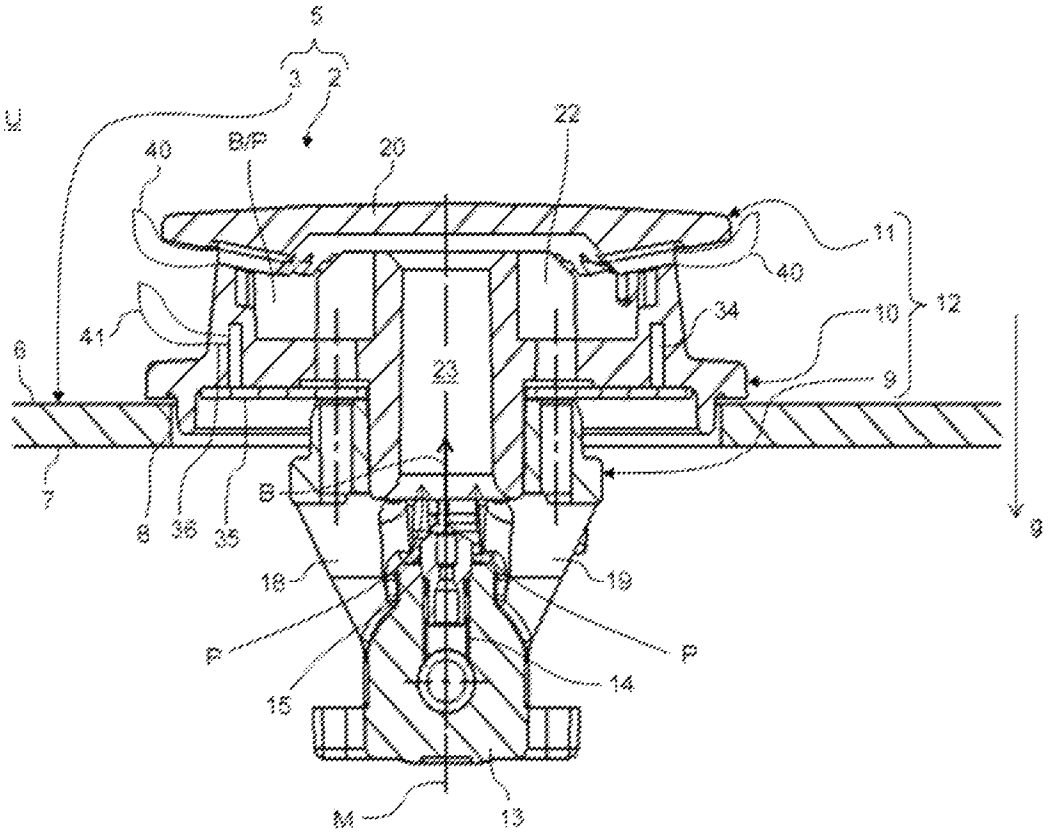
Figure 3:
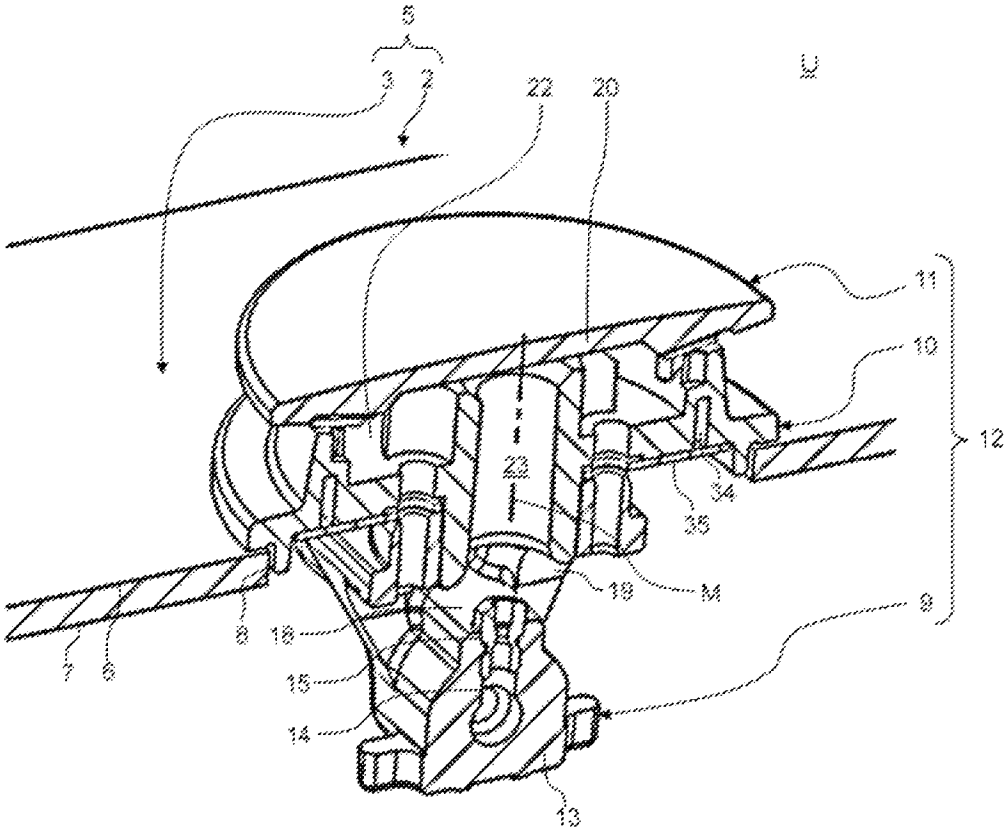
Figure 4:
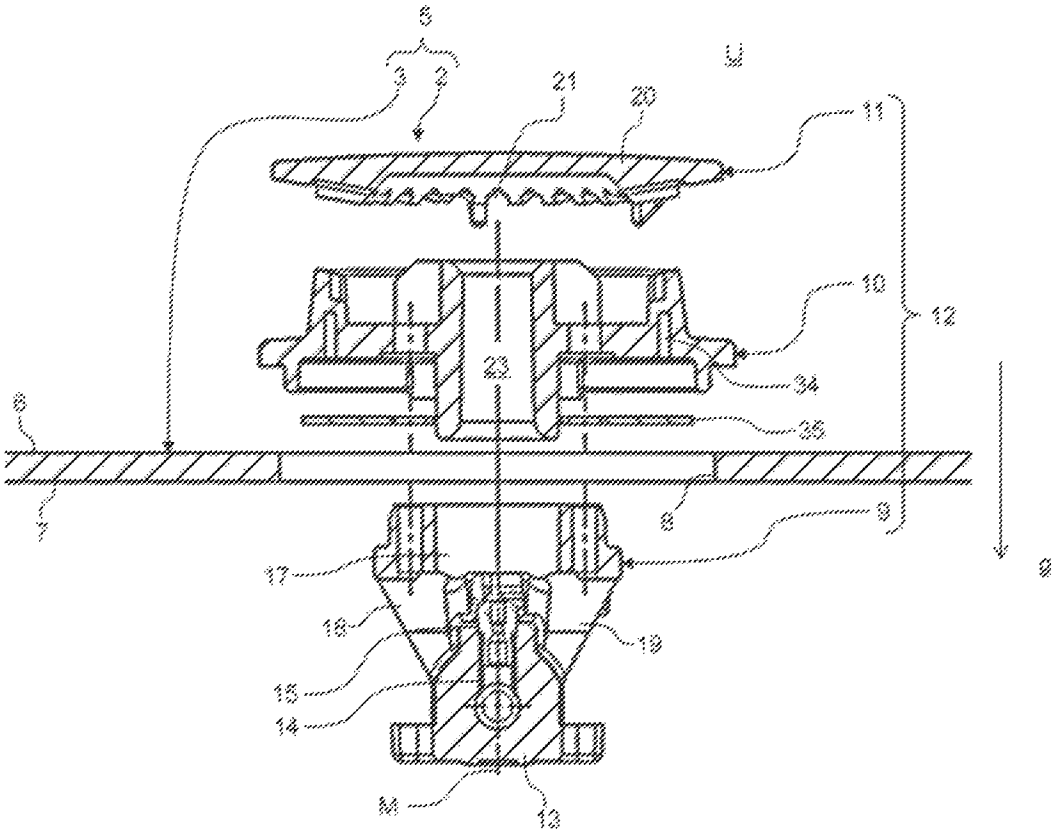
Figure 5:
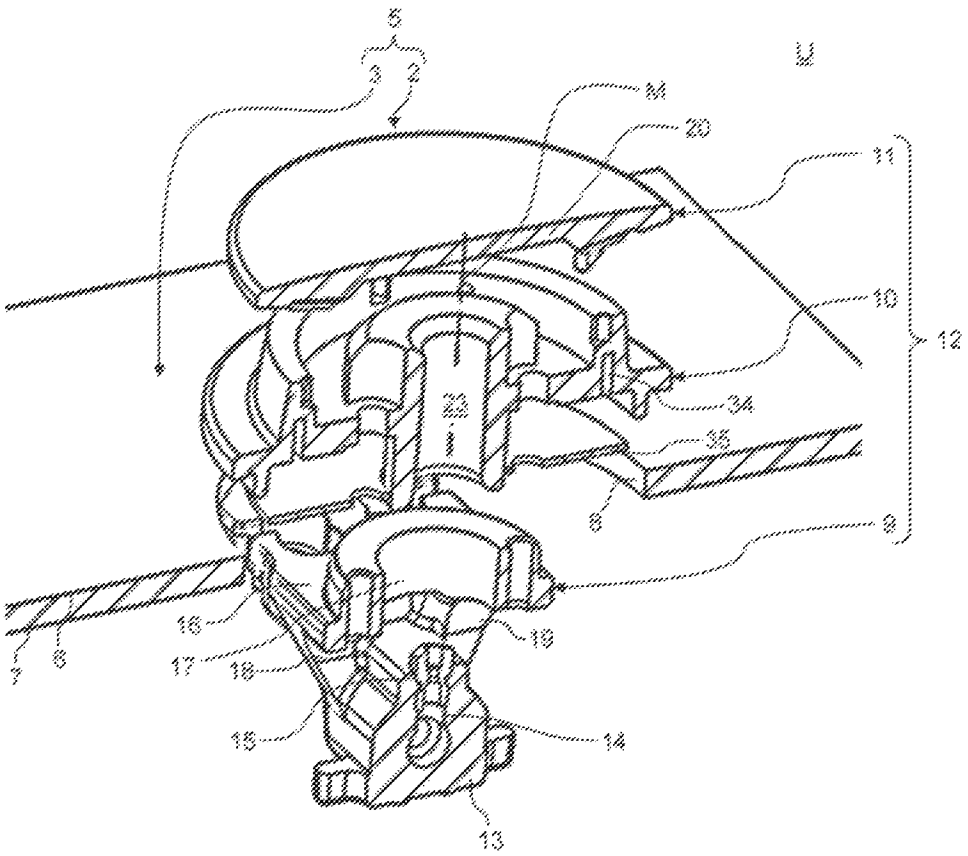
Figure 6:
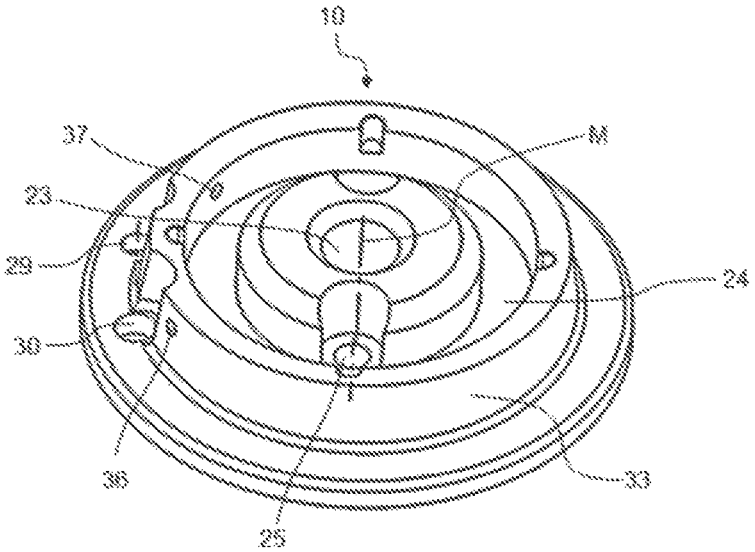
Figure 7:
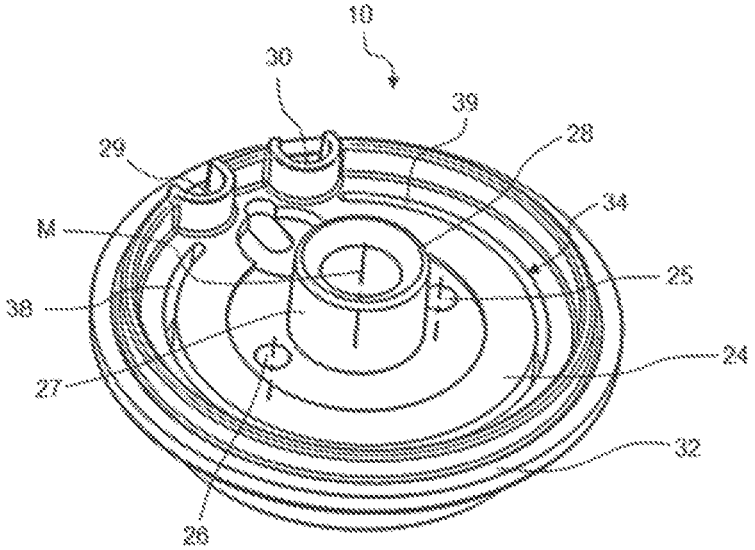
Figure 8:
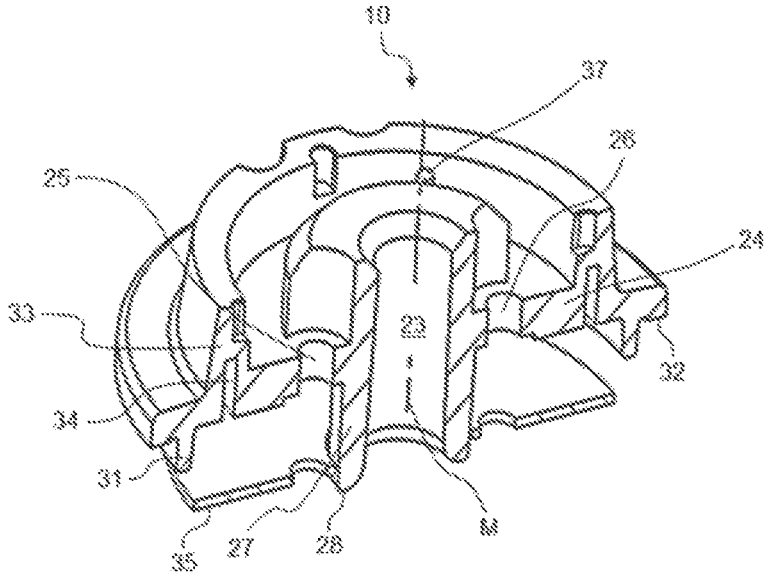
Figure 9:
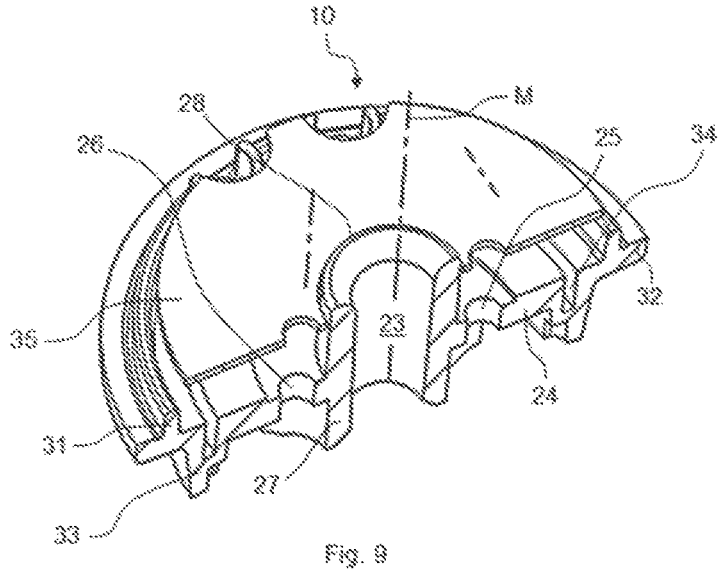
Figure 10:
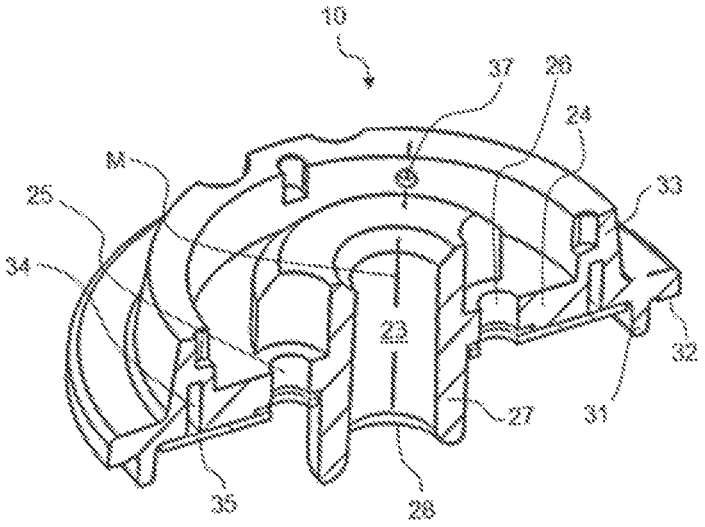

FIG. 1 shows a schematic view of an embodiment of a household cooking appliance;

FIG. 2 shows a schematic sectional view of an embodiment of a gas burner arrangement for the household cooking appliance according to FIG. 1;

FIG. 3 shows a further schematic sectional view of the gas burner arrangement according to FIG. 2;

FIG. 4 shows a schematic exploded cross-sectional view of the gas burner arrangement according to FIG. 2;

FIG. 5 shows a further schematic exploded cross-sectional view of the gas burner arrangement according to FIG. 2;

FIG. 6 shows a schematic perspective view of an embodiment of a burner base of a gas burner for the gas burner arrangement according to FIG. 2;

FIG. 7 shows a further schematic perspective view of the burner base according to FIG. 6;

FIG. 8 shows a schematic exploded cross sectional view of the burner base according to FIG. 6;

FIG. 9 shows a further schematic exploded cross sectional view of the burner base according to FIG. 6; and FIG. 10 shows a schematic sectional view of the burner base according to FIG. 6.

DETAILED DESCRIPTION OF EXEMPLARY EMBODIMENTS OF THE PRESENT INVENTION

In the figures, like or functionally equivalent elements have been provided with the same reference characters unless indicated otherwise.

FIG. 1 shows a schematic view of an embodiment of a household cooking appliance 1. The household cooking appliance 1 is in particular a gas cooker or household gas cooker. The household cooking appliance 1 may be a built-in appliance or a free-standing appliance. The household cooking appliance 1 comprises a plurality of gas burners 2. The gas burners 2 may also be designated as household appliance gas burners. There may be any desired number of gas burners 2. For example, four gas burners 2 may be provided. The gas burners 2 are arranged on a common hob plate 3. For example, the gas burners 2 may be secured to the hob plate 3. The gas burners 2 may each have a heat shield that runs peripherally around them in a ring shape and is intended to protect the hob plate 3 from being heated by the dissipation of waste heat by the gas burners 2.

The hob plate 3 may be for example a steel sheet, a glass ceramic plate or a plate of tempered glass. Associated with each gas burner 2 is a gas regulating valve or gas control valve 4A, with the aid of which a stream of combustion gas that is supplied to the respective gas burner 2 may be selectively switched on, switched off and, in particular continuously variably, adjusted. As an alternative, the gas control valves 4A may also be intended to regulate in steps the stream of combustion gas supplied to the respective gas burner 2. That is to say that the gas control valves 4A may take the form of stepped gas control valves, or so-called step valves. Moreover, the household cooking appliance 1 comprises a door 4B. The door 4B may be for example an oven door of the household cooking appliance 1. For the purpose of being opened and closed, the door 4B may be pivoted about a pivot axis provided at a lower end of the door 4B. As an alternative, the door 4B may be arranged on an oven carriage that may be pulled out of the household cooking appliance 1.

FIGS. 2 and 3 each show a schematic sectional view of a gas burner arrangement 5 for the household cooking appliance 1 according to FIG. 1. FIGS. 4 and 5 each show a schematic exploded cross sectional view of the gas burner arrangement 5. Below, reference will be made simultaneously to FIGS. 2 to 5.

The gas burner arrangement 5 comprises the hob plate 3, which has a front side 6 and, remote from the front side 6, a rear side 7. As seen in a direction of gravity g, the rear side 7 is arranged below the front side 6. Moreover, the hob plate 3 comprises an aperture 8. The aperture 8 may take a circular form. The gas burner 2 is guided through the aperture 8. The gas burner arrangement 5 may, as mentioned above, comprise a plurality of gas burners 2, in which case an aperture 8 of this kind is associated with each gas burner 2.

The gas burner 2 comprises a nozzle holder 9, which is arranged below the hob plate 3 and abuts against the rear side 7 thereof, a burner base 10, which is arranged above the hob plate 3 such that the hob plate 3 is positioned between the nozzle holder 9 and the burner base 10, and a burner lid 11. The burner lid 11 is laid on the burner base 10 such that the burner base 10 is arranged between the nozzle holder 9 and the burner lid 11. The nozzle holder 9, the burner base 10 and the burner lid 11 are mutually separate parts.

The nozzle holder 9, the burner base 10 and the burner lid 11 are made for example from an aluminum alloy or a magnesium alloy. For example, the nozzle holder 9, the burner base 10 and the burner lid 11 may each be made as die-cast aluminum parts or die-cast magnesium parts. The nozzle holder 9, the burner base 10 and the burner lid 11 are part of a burner casing 12 of the gas burner 2.

The nozzle holder 9 comprises an underlying body 13 in which there is made a bore 14. Combustion gas B may be supplied to the nozzle holder 9 through the bore 14 (FIG. 2). Received in the bore 14 is a gas nozzle 15. For example, the gas nozzle 15 is screwed into the bore 14. Moreover, the underlying body 13 comprises a bearing surface 16 (FIG. 5) by means of which the nozzle holder 9 abuts against the rear side 7 of the hob plate 3. Moreover, the underlying body 13 comprises a receiving portion 17 (FIG. 4, FIG. 5) that may be constructed to be rotationally symmetrical about a center axis or axis of symmetry M of the gas burner 2. The receiving portion 17 is cylindrical. The burner base 10 may be received, at least in certain regions, in the receiving portion 17. Moreover, two primary air openings 18, 19 are provided in the underlying body 13. With the aid of the primary air openings 18, 19, primary air P may be supplied to the gas nozzle 15 (FIG. 2). The primary air openings 18, 19 open into the receiving portion 17.

The burner lid 11 has a disk-shaped underlying portion 20. On the underside—that is to say facing the burner base 10—a plurality of mixture outlet openings 21 is provided on the underlying portion (FIG. 4). There may be any desired number of mixture outlet openings 21. The mixture outlet openings 21 are preferably arranged evenly distributed over a periphery of the burner lid 11. Provided between the burner lid 11 and the burner base 10 is a mixture distribution chamber 22, with the aid of which a mixture of combustion gas and primary air B/P (FIG. 2) may be distributed evenly to the mixture outlet openings 21. Associated with the burner base 10 is a mixing chamber 23. The mixing chamber 23 is in fluidic connection with the mixture distribution chamber 22.

As shown in FIGS. 6 to 10, the burner base 10 comprises a disk-shaped underlying portion 24. The underlying portion 24 is constructed to be rotationally symmetrical about the axis of symmetry M. Two apertures 25, 26 may be made in the underlying portion 24. Screws may pass through the apertures 25, 26 in order to screw the burner base 10 to the nozzle holder 9.

The mixing chamber 23 is provided centrally on the disk-shaped underlying portion 24 and is surrounded by a wall 27. The wall 27 projects into the mixture distribution chamber 22. An inflow edge 28 of the mixing chamber 23 that runs peripherally around in a ring shape is positioned such that the gas nozzle 15 is arranged at a distance from the inflow edge 28. That is to say that the gas nozzle 15 is not positioned within the mixing chamber 23.

Moreover, the burner base 10 comprises two receiving portions 29, 30 in which an ignition element and a thermocouple may be received. Running peripherally around the underlying portion in a ring shape there is provided a flange 31 that abuts against the aperture 8 in the hob plate 3. A bearing surface 32 abuts against the front side 6 of the hob plate 3. A wall 33 runs peripherally around the wall 27 in a ring shape. Provided between the wall 33 and the wall 27 is the mixture distribution chamber 22.

Provided in the wall 33 is a storage chamber 34. The storage chamber 34 is provided for example in the form of a rectangular groove that extends at least in certain regions into the wall 33. In this case, the storage chamber 34 runs peripherally around the mixture distribution chamber 22 in a ring shape. However, in this case the ring-shaped geometry of the storage chamber 34 is not closed. That is to say that—as shown in FIG. 7—the storage chamber 34 does not run around the mixture distribution chamber 22 in a peripheral angle of 360° but for example in a peripheral angle of only 300°. The storage chamber 34 is open in the direction of the front side 6 of the hob plate 3 and is closed off with the aid of a closure plate 35, for example with the aid of a metal closure sheet glued to the nozzle holder 9. The closure plate 35 is a separate part from the nozzle holder 9.

As shown in FIG. 6, the storage chamber 34 comprises an ignition flame opening 36. The ignition flame opening 36 faces an area U (FIG. 1) surrounding the gas burner 2. The ignition flame opening 36 may take the form of a bore that passes partly through the wall 33. Moreover, the storage chamber 34 comprises a supply opening 37, with the aid of which the storage chamber 34 is in fluidic connection with the mixture distribution chamber 22. The supply opening 37 may take the form of a bore that passes partly through the wall 33. The supply opening 37 may in this case have a larger diameter than the ignition flame opening 36.

The storage chamber 34 is constructed to be rotationally symmetrical about the axis of symmetry M. The storage chamber 34 forms a cavity in the burner casing 12 or burner base 10 that, apart from the ignition flame opening 36 and the supply opening 37, is entirely surrounded by the burner casing 12. The ignition flame opening 36 is provided at a first end portion 38 (FIG. 7) of the storage chamber 34, and the supply opening 37 is provided at a second end portion 39 (FIG. 7) of the storage chamber 34, at the opposite end to the first end portion 38. In this way, the ignition flame opening 36 and the supply opening 37 are at the maximum possible distance from one another. That is to say that the mixture of combustion gas and primary air B/P has to cover the greatest possible path in the storage chamber 34 from the supply opening 37 to the ignition flame opening 36.

The functionality of the gas burner 2 and the gas burner arrangement 5 is explained below with reference to FIG. 2. During operation of the gas burner 2, the combustion gas B is supplied to the gas nozzle 15 through the bore 14. The combustion gas B flows out of the gas nozzle 15 and is injected into the mixing chamber 23. This produces a Venturi effect, as a result of which the primary air P is drawn in by suction through the primary air openings 18, 19 and into the mixing chamber 23. In the mixing chamber 23, the primary air P mixes with the combustion gas B. The resulting mixture of combustion gas and primary air B/P is distributed evenly to the mixture outlet openings 21 with the aid of the mixture distribution chamber 22, wherein the mixture of combustion gas and primary air B/P is guided out into the area U surrounding the gas burner 2 for the purpose of producing a burner flame 40.

At the same time, some of the mixture of combustion gas and primary air B/P is supplied through the supply opening 37 to the storage chamber 34. Some of the mixture of combustion gas and primary air B/P is stored in the storage chamber 34, wherein the mixture of combustion gas and primary air B/P stored in the storage chamber 34 is guided through the ignition flame opening 36 and out into the surrounding area U for the purpose of producing a pilot flame or ignition flame 41.

In the surrounding area U, the mixture of combustion gas and primary air B/P burns, forming the ignition flame 41 or the burner flame 40. The ignition flame 41 burns continuously when the gas burner 2 is in operation. If the burner flame 40 is extinguished, for example because of a brief interruption in the incoming flow of combustion gas B or a pressure pulse caused for example by opening or closing the door 4B, the ignition flame 41 continues to burn, because the mixture of combustion gas and primary air B/P stored in the storage chamber 34 continues to flow out of the ignition flame opening 36. The storage chamber 34 may be intended to store the mixture of combustion gas and primary air B/P such that if the burner flame 40 is extinguished the ignition flame 41 continues to burn for periods from a few fractions of a second to a few seconds.

Because the storage chamber 34 is provided for the purpose of storing the mixture of combustion gas and primary air B/P, the ignition flame 41 can continue to burn even in the event of a brief interruption in the supply of combustion gas and/or in the event of extinction of the burner flame 40 without an additional gas supply line to the ignition flame opening 36. As a result, legal requirements, for example under DIN EN 30, can be met. In particular, tests comprising the opening and closing of the door 4B can be performed without the gas burner 2 being completely extinguished. Moreover, the ignition flame 41 may also be used for flame detection.

The invention claimed is:

1. A gas burner for a household cooking appliance, said gas burner comprising:

a burner casing comprising a plurality of mixture outlet openings configured to guide out, during operation of the gas burner, a mixture of combustion gas and primary air into an area surrounding the gas burner for producing a burner flame;

a mixture distribution chamber for evenly distributing the mixture of combustion gas and primary air to the mixture outlet openings; and a storage chamber in fluidic connection with the mixture distribution chamber for storing, during operation of the gas burner, part of the mixture of combustion gas and primary air, said storage chamber comprising an ignition flame opening configured to guide out the mixture of combustion gas and primary air that is stored in the storage chamber into the surrounding area for producing an ignition flame, wherein the storage chamber is in fluidic connection with the mixture distribution chamber via a supply opening and runs peripherally around the mixture distribution chamber in a ring shape extending from the supply opening to the ignition flame opening, the storage chamber has a first end portion and a second end portion in opposition to the first end portion, the ignition flame opening being provided at the first end portion of the storage chamber, and the supply opening being provided at the second end portion of the storage chamber, and the ignition flame opening and the supply opening are at a maximum possible distance from one another along a length of the ring shape of the storage chamber.

2. The gas burner of claim 1, wherein the storage chamber runs peripherally around the mixture distribution chamber in a ring shape.

3. The gas burner of claim 2, wherein the storage chamber has a ring-shaped geometry which is open.

4. The gas burner of claim 1, wherein the storage chamber has a rectangular cross section.

5. The gas burner of claim 1, wherein the mixture distribution chamber and the storage chamber are constructed to be rotationally symmetrical about an axis of symmetry of the burner casing.

6. The gas burner of claim 1, wherein the storage chamber is in fluidic connection with the mixture distribution chamber via a supply opening.

7. The gas burner of claim 6, wherein the storage chamber forms a cavity that, apart from the ignition flame opening and the supply opening, is entirely surrounded by the burner casing.

8. The gas burner of claim 6, wherein the storage chamber has a first end portion and a second end portion in opposition to the first end portion, said ignition flame opening being provided at the first end portion of the storage chamber, and said supply opening being provided at the second end portion of the storage chamber.

9. The gas burner of claim 1, wherein the burner casing comprises a nozzle holder, a burner base and a burner lid, said burner base being arranged between the nozzle holder and the burner lid.

10. The gas burner of claim 9, wherein the mixture distribution chamber and the storage chamber are provided in the burner base.

11. The gas burner of claim 9, wherein the burner casing includes a closure plate configured to close off the storage chamber in a direction towards the nozzle holder.

12. The gas burner of claim 9, wherein the burner base comprises a mixing chamber in fluidic connection with the mixture distribution chamber for mixing combustion gas with primary air, said mixing chamber extending at least in part through the mixture distribution chamber.

13. The gas burner of claim 12, wherein the nozzle holder comprises a gas nozzle for injecting combustion gas into the mixing chamber, said gas nozzle being arranged at a distance from an inflow edge of the mixing chamber.

14. A gas burner arrangement, comprising:

a hob plate; and a gas burner mounted on the hob plate, said gas burner comprising a burner casing comprising a plurality of mixture outlet openings configured to guide out, during operation of the gas burner, a mixture of combustion gas and primary air into an area surrounding the gas burner for producing a burner flame, a mixture distribution chamber for evenly distributing the mixture of combustion gas and primary air to the mixture outlet openings, and a storage chamber in fluidic connection with the mixture distribution chamber for storing, during operation of the gas burner, part of the mixture of combustion gas and primary air, said storage chamber comprising an ignition flame opening configured to guide out the mixture of combustion gas and primary air that is stored in the storage chamber into the surrounding area for producing an ignition flame, wherein the storage chamber is in fluidic connection with the mixture distribution chamber via a supply opening and runs peripherally around the mixture distribution chamber in a ring shape extending from the supply opening to the ignition flame opening, the storage chamber has a first end portion and a second end portion in opposition to the first end portion, the ignition flame opening being provided at the first end portion of the storage chamber, and the supply opening being provided at the second end portion of the storage chamber, and the ignition flame opening and the supply opening are at a maximum possible distance from one another along a length of the ring shape of the storage chamber.

15. A household cooking appliance, comprising at least one of a gas burner and a gas burner arrangement, said gas burner comprising a burner casing comprising a plurality of mixture outlet openings configured to guide out, during operation of the gas burner, a mixture of combustion gas and primary air into an area surrounding the gas burner for producing a burner flame, a mixture distribution chamber for evenly distributing the mixture of combustion gas and primary air to the mixture outlet openings, and a storage chamber in fluidic connection with the mixture distribution chamber for storing, during operation of the gas burner, part of the mixture of combustion gas and primary air, said storage chamber comprising an ignition flame opening configured to guide out the mixture of combustion gas and primary air that is stored in the storage chamber into the surrounding area for producing an ignition flame, said gas burner arrangement comprising a hob plate, said gas burner being mounted on the hob plate, wherein the storage chamber is in fluidic connection with the mixture distribution chamber via a supply opening and runs peripherally around the mixture distribution chamber in a ring shape extending from the supply opening to the ignition flame opening, the storage chamber forms an enclosed hollow that is only in fluidic connection with the surrounding area by way of the ignition flame opening and with the mixture distribution chamber by way of the supply opening, and the ignition flame opening and the supply opening are at a maximum possible distance from one another along a length of the ring shape of the storage chamber.

16. The household cooking appliance of claim 15, constructed in the form of a gas cooker.

* * * * *